US007376989B2

(12) United States Patent
Wickstrom et al.

(10) Patent No.: US 7,376,989 B2
(45) Date of Patent: May 27, 2008

(54) FOLDABLE BEDDING FOUNDATION

(75) Inventors: Brenda Wickstrom, Carthage, MO (US); Niels Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 263 days.

(21) Appl. No.: 11/326,005

(22) Filed: Jan. 5, 2006

(65) Prior Publication Data

US 2006/0123541 A1 Jun. 15, 2006

Related U.S. Application Data

(63) Continuation-in-part of application No. 10/842,820, filed on May 11, 2004.

(51) Int. Cl.
*A47C 23/00* (2006.01)

(52) U.S. Cl. ..... 5/250

(58) Field of Classification Search ..... None
See application file for complete search history.

(56) References Cited

U.S. PATENT DOCUMENTS 4,377,279 A 3/1983 Schulz, Jr. et al.
4,489,450 A 12/1984 Miller
4,620,336 A 11/1986 Miller
4,654,905 A 4/1987 Miller
4,704,752 A 11/1987 Yates et al.
4,770,397 A 9/1988 Schulz, Jr.
4,771,995 A 9/1988 Wells et al.
4,903,949 A 2/1990 Schulz, Jr.
5,346,188 A 9/1994 Rodgers et al.
5,551,104 A 9/1996 Hartline
5,622,357 A 4/1997 Schulz, Jr. et al.
5,765,240 A 6/1998 Workman
6,012,190 A 1/2000 Rogers
6,032,307 A 3/2000 Workman
6,651,276 B2 11/2003 McCraw et al.

*Primary Examiner*—Tara L. Mayo
(74) *Attorney, Agent, or Firm*—Wood, Herron & Evans, LLP

(57) ABSTRACT

A foldable bedding foundation comprising a first section is hingedly secured to a second section so that the bedding foundation may be folded for storage or transportation purposes. Each section has base, a plurality of wire struts pivotally secured to the base, an upper wire grid pivotally secured to the wire struts and braces extending between the base and an outermost wire strut. Lower connectors each comprising a rectangular piece of plastic having living hinges is secured to and extends between the bases. Upper connectors are secured to and extend between border wires of the sections to aid in the collapsing of the foundation.

13 Claims, 9 Drawing Sheets

FOLDABLE BEDDING FOUNDATION

CROSS REFERENCE TO RELATED APPLICATIONS

This application is a continuation-in-part of U.S. patent application Ser. No. 10/842,820, filed May 11, 2004, entitled "Foldable Bedding Foundation," which is hereby incorporated by reference herein in its entirety.

FIELD OF THE INVENTION

This invention relates generally to bedding foundations and more particularly to a bedding foundation which is collapsible for storage and shipment.

BACKGROUND OF THE INVENTION

Conventional bedding foundations such as box springs typically include an array or matrix of springs, a wooden base and an upper grid including a generally rectangular border wire. The springs may be coil springs or modular springs. The components are commonly shipped from a spring manufacturer to a box spring manufacturer separately. Once the components arrive at the box spring manufacturer's facility, the box spring manufacturer attaches the lower ends of the springs which extend downwardly from an upper wire grid assembly to a base. Padding and a cover is applied by the box spring manufacturer as desired. Such conventional bedding foundations are large and cumbersome to handle in storage, transportation or shipment which, of course, increases the ultimate cost.

Moreover, it is not uncommon for a coil spring manufacturer to compress or deform coil springs units layered one on top of the other into condensed or compacted multilayered packs for shipment to a box spring manufacturer. The aforementioned step is performed by means of a press machine enabling the foundation units to be compressed to reduce their height dimension. The coil spring units of each pack are held in their compacted state against return to their normal or unstressed condition by means of strapping applied about the unit. The spring units of each pack being compressed, the strapping is under a great amount of tension. When the packs arrive at the place of the manufacturer, it is, of course, necessary to sever the strapping around the packs in order to release the spring units for installation into box springs or mattresses. This, of course, is difficult because of the high degree of tension to which the strapping is subjected by the compression of the coil springs.

U.S. Pat. No. 4,377,279 discloses a wire foundation unit for a box spring which may be shipped to a box spring manufacturer in a collapsed condition. The manufacturer would erect the foundation wires and then fix by staples, rigid struts between the wire unit and base to permanently secure the wire unit in the erected position. The box spring manufacturing process is completed by providing the conventional layer of padding on the top of the wire foundation and a sheet covering or casing about the entire unit. However, once the manufacture is completed, the box spring is no longer collapsible and thus must be shipped in its expanded or full-size state to the point of retail or use whereby the same storage and shipment costs result at this point as with conventional box springs.

U.S. Pat. No. 4,654,905 discloses another collapsible bedding foundation for a box spring which can be shipped to a box spring manufacturer in a collapsed condition. The box spring manufacturer would erect the collapsed bedding foundation before applying padding on the top of the erected bedding foundation and covering or casing the entire unit. The collapsible bedding foundation disclosed in this patent utilizes a hinge to connect two sections of the bedding foundation so that when collapsed one section may overlay the other section. One drawback to this bedding foundation is that the hinge is expensive, thereby adding substantial cost to the manufacturer of the collapsible bedding foundation which is in turn passed on to the manufacturer of the box spring.

Therefore, there is a need for a collapsible box spring which is less expensive to manufacture than known collapsible box springs. There is further a need for an affordable box spring which may be collapsed after being upholstered.

SUMMARY OF THE INVENTION

The bedding foundation of the present invention comprises two sections which are hingedly secured together with upper and lower hinges or connectors. Each section comprises a plurality of wire struts or support members movable between a retracted or collapsed position and an extended or erected position. In one embodiment, each of the wire struts is generally U-shaped. In another embodiment, each of the wire struts has a square wave-shaped configuration. In their retracted positions, the support members are generally unstressed and lie in generally horizontal planes. Thus, the bedding foundation is substantially reduced in its depth dimension thereby facilitating storage handling and/or shipment at reduced unit cost. In their extended positions, the support members are erect in generally vertical planes and thus, the bedding foundation is ready for use. After use, the bedding foundation may be collapsed to its storage position and then later expanded to its use or erected position. This process by be repeated as often as desired.

In one embodiment, the bedding foundation or body support is constructed to be foldable or collapsible upon itself into two overlying sections, thus reducing the length approximately in half for storage. This action is also used to actuate the support members from their erected positions into their retracted positions. Unfolding of the bedding foundation sections to place them into a coplanar position moves the support members from their retracted position to their erect position for providing support for the body when in use.

The two sections of the bedding foundation are joined with upper and lower hinges or connectors. One or more lower hinge or connector secured to the bases of the sections extend(s) therebetween. In one embodiment, the lower hinge or connector is a wire assuming a square wave form. In another embodiment, each lower connector is generally rectangular and has a pair of living hinges built therein so that when the bedding foundation is collapsed, each lower connector assumes a generally U-shaped configuration and when the bedding foundation is erected, each lower connector is generally planar. Such lower connectors are preferably made of plastic, but may be made of any desirable material. Other types or configurations of lower hinges or connectors comprising one or more components may be used in accordance with the present invention.

At least one upper hinge or connector is secured to the wire grid of each section and extends therebetween. In one embodiment, the upper hinge comprises a pair of spaced, plastic connectors. The connectors provide spacing between the border wires of the upper grids of the foundation sections which facilitates folding of the foundation, even when fully upholstered. However, other types or configurations of upper hinges or connectors may be used in accordance with the present invention such as a helical connector, for example.

Each section of the foundation preferably has two braces which maintain the wire struts or support members in a generally vertical orientation when the bedding foundation is in its erected position or condition. The braces provide stability to the foundation when the bedding foundation is erect and a load placed thereon. Each of these braces is generally V-shaped and has a pair of arms extending outwardly from a bottom portion which is stapled or otherwise secured to one of the cross rails of the base of one of the foundation sections. Each arm of the brace terminates in an arcuate portion which is slidably engaged with an outermost wire strut of the section. The braces move between an upper position when the bedding foundation is in its erected position and a lower position when the bedding foundation is in its collapsed position. Other numbers or configurations of braces may be used in accordance with the present invention.

BRIEF DESCRIPTION OF THE DRAWINGS

These objectives and features of the invention will become more readily apparent from the following detailed description taken in conjunction with the accompanying drawings in which.

DETAILED DESCRIPTION OF THE INVENTION

Figure 1:
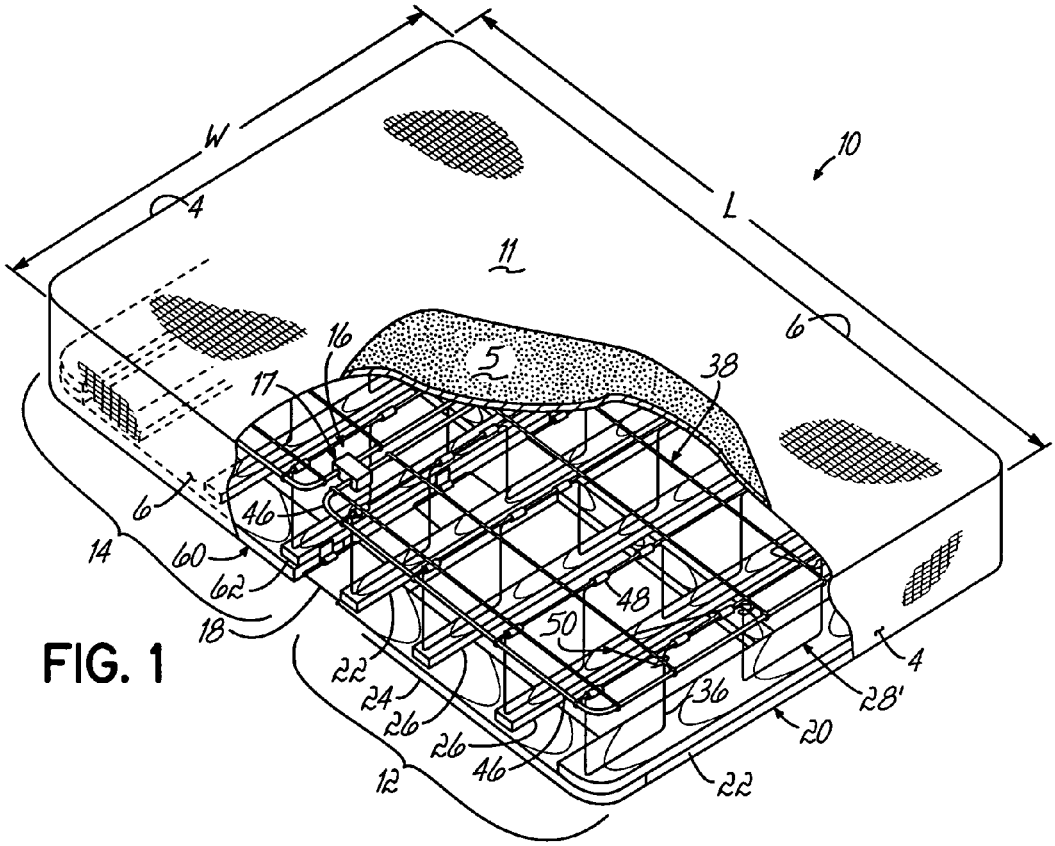
FIG. 1 is a perspective view of one embodiment of the collapsible bedding foundation of the present invention in an erected condition.
Figure 4:
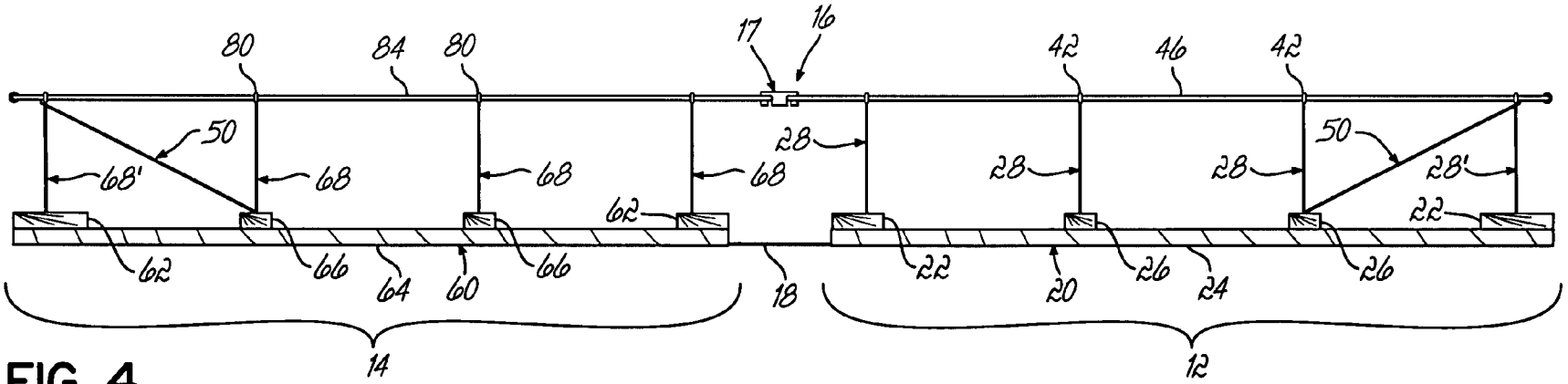
FIG. 4 is a side elevational view of the collapsible bedding foundation of FIG. 1 without a cover in an erected condition.
Figure 5:
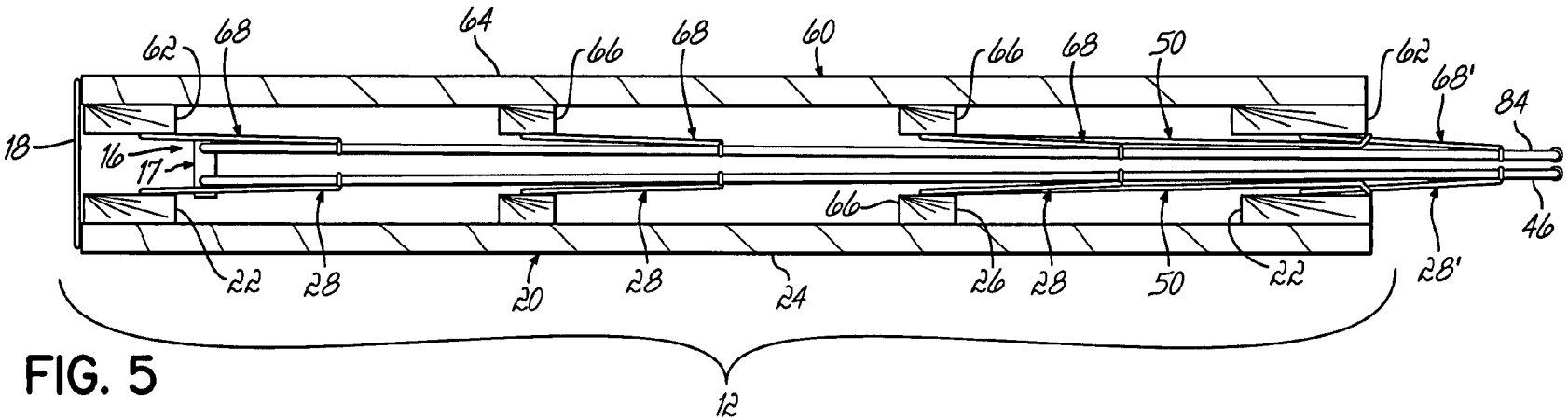
FIG. 5 is a side elevational view of the collapsible bedding foundation of FIG. 1 without a cover in a collapsed condition.

Referring to the drawings, and particularly to FIG. 1, there is illustrated a foldable or collapsible bedding foundation 10. The bedding foundation 10 has a pair of end surfaces 4 defining a length or longitudinal dimension L of the foundation 10 and a pair of opposed side surfaces 6 defining a width W of the foundation 10. The bedding foundation 10 has a first section 12 hinged to a second section 14 with an upper hinge 16 and lower hinge 18. See FIG. 4. The hinges 16, 18 enable the bedding foundation 10 to move from an erected position shown in FIGS. 1 and 4 to a collapsed position shown in FIG. 5. Although FIGS. 4 and 5 illustrate the bedding foundation 10 with no cover, the bedding foundation 10 may be collapsed with a surrounding cover 111 as shown in FIG. 1. If desired padding 5 may be placed on the upper surface of the bedding product 10 before the surrounding cover 11 is attached.

Figure 2:
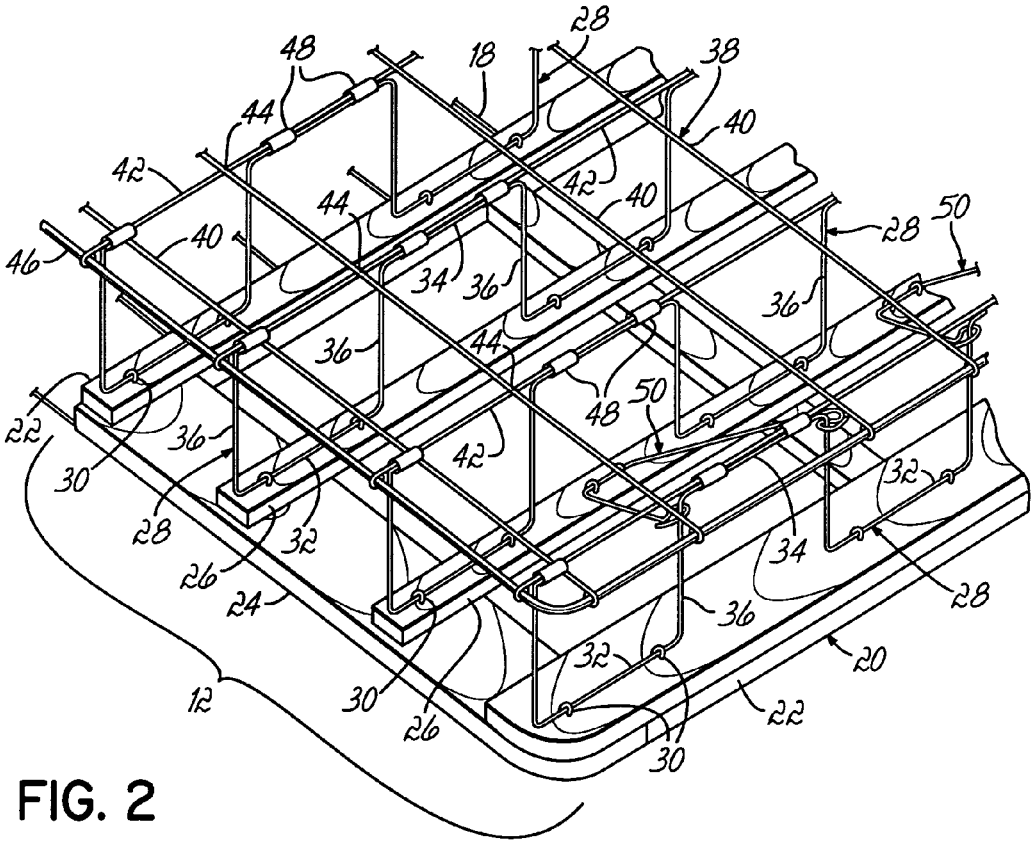
FIG. 2 is an enlarged perspective view of a portion of the first section of the collapsible bedding foundation of FIG. 1.
Figure 3:
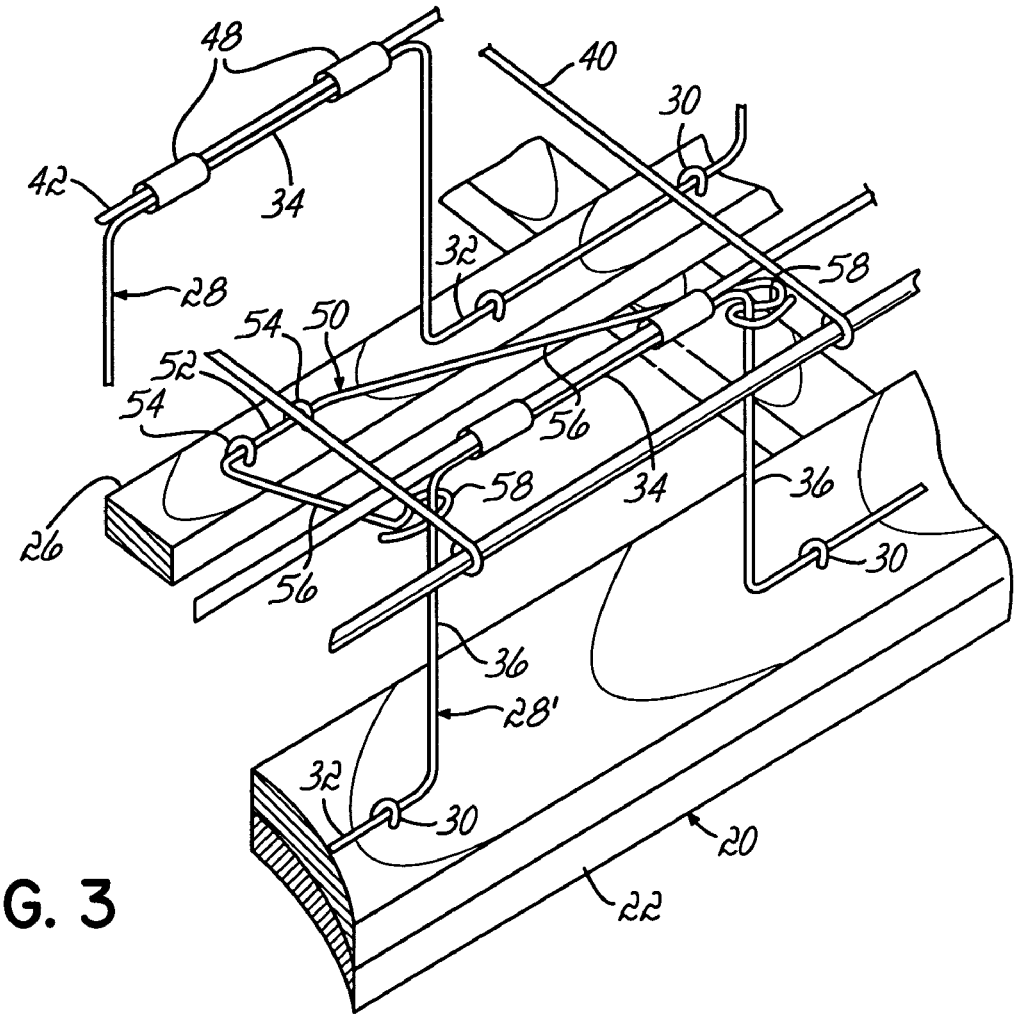
FIG. 3 is an enlarged perspective view of a portion of the first section of the collapsible bedding foundation of FIG. 1 illustrating one brace in detail.

Referring to FIGS. 1 and 2, the first section 12 comprises a first base 20 having a pair of opposed end rails 22, a pair of opposed side rails 24 and a plurality of cross rails 26, as is conventional. As shown in FIGS. 2 and 3, a plurality of first wire struts or body supports 28 are pivotally secured to the cross rails 26 and end rails 22 of the first base 20 with staples 30. Each wire strut 28 has a square wave shape including a plurality of spaced lower portions 32 which are co-linear and a plurality of spaced upper portions 34 which are co-linear. The upper and lower portions 34, 32 are joined with spaced, parallel connecting portions 36. The lower portions 32 of each wire strut 28 are stapled to the cross rails 26 and end rails 22 of the first base 20 with staples 30 so the wire strut 28 may pivot relative to the first base 20. When the bedding foundation 10 is in its erected condition or position as shown in FIGS. 1 and 4, the connecting portions 36 of the wire struts 28 are vertically oriented and the upper and lower portions 34, 32 of the wire struts 28 are horizontally oriented.

The first section 12 of the collapsible bedding foundation 10 further comprises a first upper grid 38 comprising a plurality of spaced, parallel longitudinal grid wires 40 and a plurality of spaced, parallel transverse grid wires 42 intersecting with and secured to the longitudinal grid wires 40 at intersections 44. A generally rectangular border wire 46 surrounds the longitudinal grid wires 40 and transverse grid wires 42 and forms a part of the upper grid 38. The ends of the longitudinal grid wires 40 and transverse grid wires 42 are wrapped around, welded or otherwise secured to the border wire 46, as is conventional.

As best seen in FIG. 2, the upper portions 34 of each wire strut 28 are pivotally secured to the transverse grid wires 42 of the first upper grid 38 with metal clips 48 so the wire strut 28 may pivot relative to the first upper grid 38. Securing devices other than metal clips such as plastic clips or helical lacing wires may used if desired to pivotally secure the upper portions 34 of the wire struts 28 to the transverse grid wires 42 of the first upper grid 38. As best shown in FIG. 3, although two metal clips 48 are illustrated securing each different upper portion 34 of each wire strut 28 to a transverse grid wire 42, any number of metal clips 48 may be used to do so.

As shown in FIGS. 1, 2 and 3, a pair of braces 50 extend between one of the cross rails 26 of the first base 20 and an outermost wire strut 28' of the first section 12 of the bedding foundation 10. As best illustrated in FIG. 3, each brace 50 comprises a linear bottom portion 52 pivotally secured to the cross rail 26 with staples 54 and a pair of arms 56 extending outwardly from opposed ends of the bottom portion 52 of the brace 50. Each arm 56 terminates in an end portion 58 which comprises an arched or arcuate wire wrapped around one of the connecting portions 36 of the outermost wire strut 28'. As the bedding foundation 10 is collapsed from its erected position shown in FIG. 4 to its collapsed position shown in FIG. 5, the end portions 58 of the braces 50 slide down the connecting portions 36 of the outermost wire strut 28' until they come to rest in a substantially horizontal orientation as shown in FIG. 5.

Figure 2A:
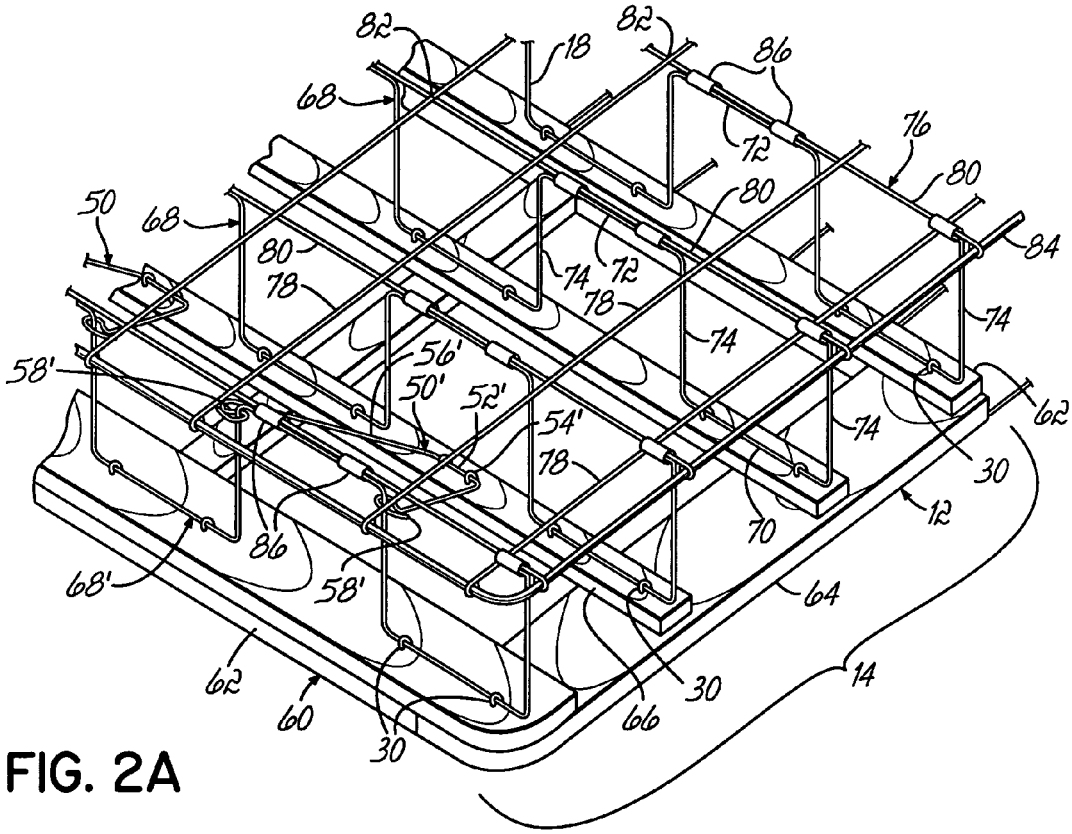
FIG. 2A is an enlarged perspective view of a portion of the second section of the collapsible bedding foundation of FIG. 1.

Referring to FIGS. 1 and 2A, the second section 14 of the bedding foundation 10 comprises a second base 60 having a pair of opposed end rails 62, a pair of opposed side rails 64 and a plurality of cross rails 66, as is conventional. As shown in FIG. 2A, a plurality of second wire struts or body supports 68 are pivotally secured to the cross rails 66 and end rails 62 of the second base 60 with staples 30. Each wire strut 68 has a square wave shape including a plurality of spaced lower portions 70 which are co-linear and a plurality of spaced upper portions 72 which are co-linear. The upper and lower portions 72, 70 are joined with spaced, parallel connecting portions 74. The lower portions 70 of each wire strut 68 are stapled to the cross rails 66 and end rails 62 of the second base 60 with staples 30 so the wire strut 68 may pivot relative to the second base 60. When the bedding foundation 10 is in its erected condition or position as shown in FIGS. 1 and 4, the connecting portions 74 of the wire struts 68 are vertically oriented and the upper and lower portions 72, 70 of the wire struts 68 are horizontally oriented.

Referring to FIG. 2A, the second section 14 of the collapsible bedding foundation 10 further comprises a second upper grid 76 comprising a plurality of spaced, parallel longitudinal grid wires 78 and a plurality of spaced, parallel transverse grid wires 80 intersecting with and secured to the longitudinal grid wires 78 at intersections 82. A generally rectangular border wire 84 surrounds the longitudinal grid wires 78 and transverse grid wires 80 and forms a part of the upper grid 76. The ends of the longitudinal grid wires 78 and transverse grid wires 80 are wrapped around, welded or otherwise secured to the border wire 84, as is conventional.

The upper portions 72 of each wire strut 68 are pivotally secured to the transverse grid wires 80 of the second upper grid 76 with metal clips 86 so the wire strut 68 may pivot relative to the second upper grid 76. Securing devices other than metal clips such as plastic clips or helical lacing wires may used if desired to pivotally secure the upper portions 72 of the wire struts 68 to the transverse grid wires 80 of the second upper grid 76. As best shown in FIG. 3, although two metal clips 86 are illustrated securing each different upper portion 72 of each wire strut 68 to a transverse grid wire 80, any number of metal clips 86 may be used to do so.

As shown in FIG. 2A, a pair of braces 50' extend between one of the cross rails 66 of the second base 60 and an outermost wire strut 68' of the second section 14 of the bedding foundation 10. As best illustrated in FIG. 2A, each brace 50' is a mirror image of brace 50 shown in FIG. 3. Each brace 50' has a bottom portion 52' which is pivotally secured to the cross rail 66 with staples 54 and a pair of arms 56' extending outwardly from opposed ends of the bottom portion 52' of the brace 50'. Each arm 56' terminates in an end portion 58' which comprises an arched or arcuate wire wrapped around one of the connecting portions 74 of the outermost wire strut 68'. As the bedding foundation 10 is collapsed from its erected position shown in FIG. 4 to its collapsed position shown in FIG. 5, the end portions 58' of the braces 50' slide down the connecting portions 74 of the outermost wire strut 68' until they come to rest in a substantially horizontal orientation as shown in FIG. 5.

Figure 6:
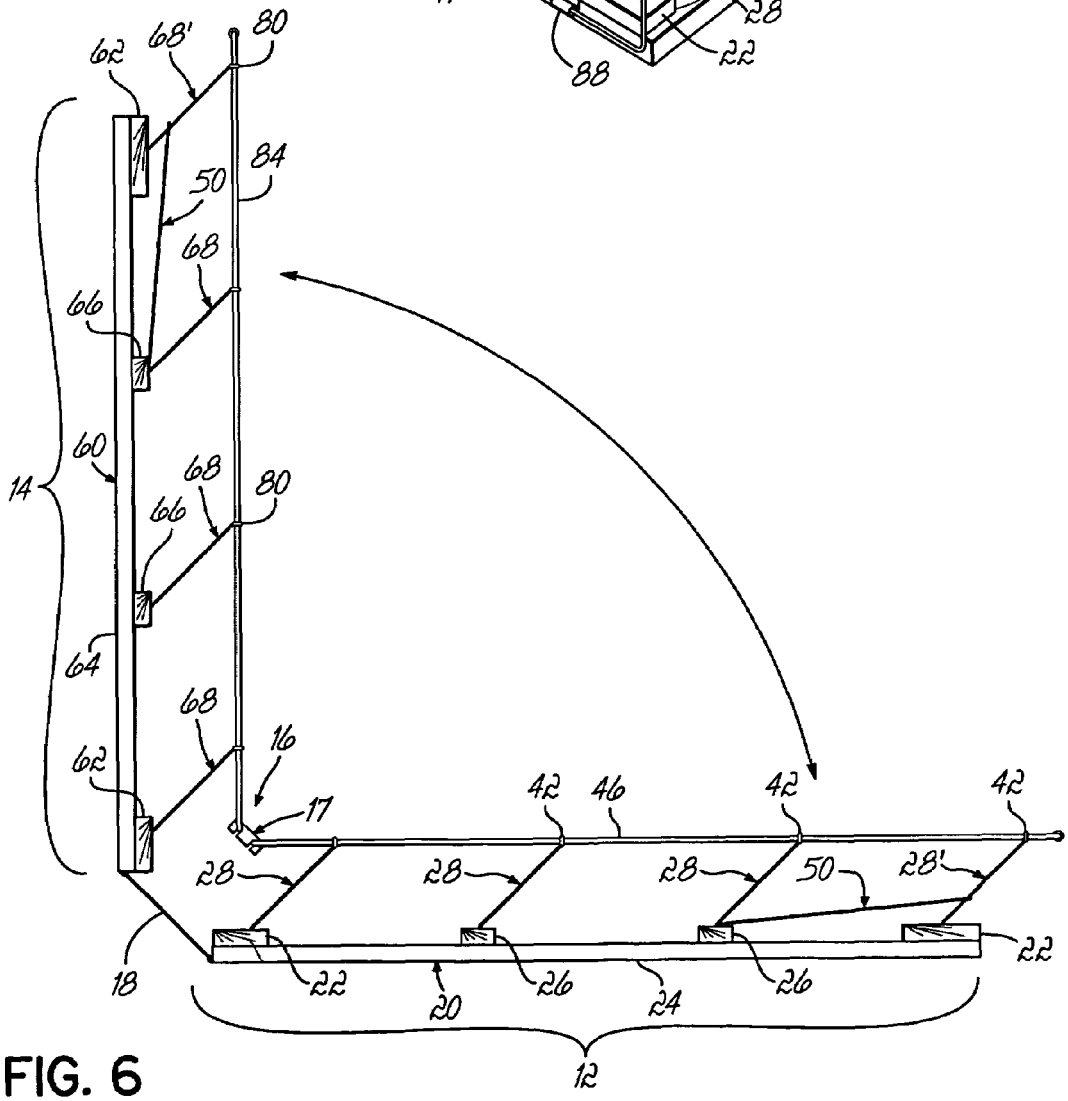
FIG. 6 is a side elevational view of the collapsible bedding foundation of FIG. 1 without a cover being collapsed.

As best illustrated in FIGS. 1 and 6, the first and second sections 12, 14 of the bedding foundation 10 are connected to each other with an upper hinge 16 and a lower hinge 18. The upper hinge 16 connects the first upper grid 38 to the second upper grid 76 and more particularly connects the first border wire 46 of the first upper grid 38 to the second border wire 84 of the second upper grid 76. In one embodiment, illustrated in FIG. 1, the upper hinge 16 comprises a pair of connectors 17 (only one shown in FIGS. 1 and 6) clipped onto portions of the first and second border wires 46, 84, respectively. Each connector 17 functions to space the first upper grid 38 from the second upper grid 76 and is preferably made of plastic, but may be made of any other suitable material.

Figure 8:
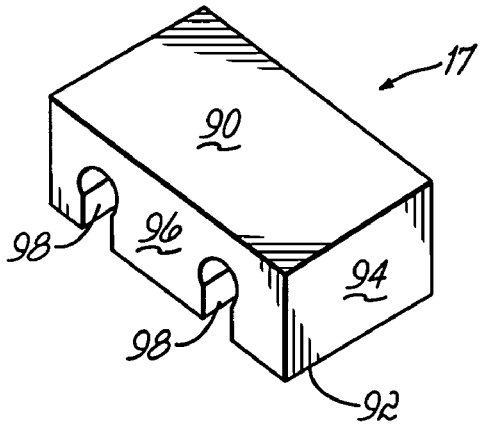
FIG. 8 is a perspective view of one of the connectors of the bedding foundation of FIG. 1.

FIG. 8 illustrates one of the connectors 17 having a top wall 90, bottom wall 92, end walls 94 and side walls 96. Two grooves 98 are formed inwardly from the bottom wall 92 and are sized to receive and retain portions of the border wires 46, 84. In accordance with the present invention, the upper hinge 16 may assume other configurations and be made of any suitable material. Although the upper hinge 16 preferably comprises two connectors 17, it may comprise any number of connectors 17.

Figure 1A:
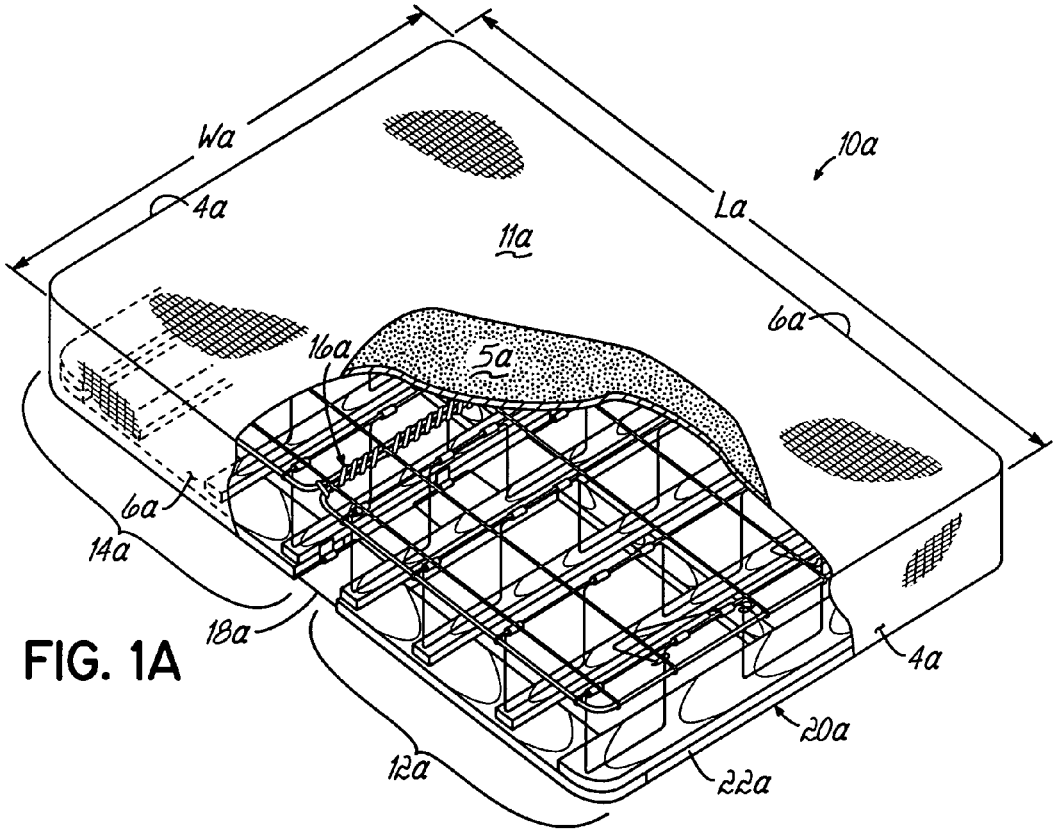
FIG. 1A is a perspective view of an alternative embodiment of the collapsible bedding foundation of the present invention in an erected condition.

FIG. 1A illustrates an alternative embodiment of collapsible bedding foundation 10*a*. The bedding foundation 10*a* has a pair of end surfaces 4*a* defining a length or longitudinal dimension La of the foundation 10*a* and a pair of opposed side surfaces 6*a* defining a width Wa of the foundation 10*a*. The bedding foundation 10*a* has a first section 12*a* hinged to a second section 14*a* with an upper hinge 16*a* and lower hinge 18*a*. The upper hinge 16*a* comprises a helical lacing member or connector made of either plastic or metal. The hinges 16*a*, 18*a* enable the bedding foundation 10*a* to move from an erected position shown in FIG. 1A to a collapsed position (not shown). The bedding foundation 10*a* may be collapsed with a surrounding cover 11*a* as shown in FIG. 1A. If desired padding 5*a* may be placed on the upper surface of the bedding product 10*a* before the surrounding cover 11*a* is attached. In all respects other than the upper hinge 16*a*, this collapsible bedding foundation 10*a* is identical to the collapsible bedding foundation 10 shown in FIG. 1.

Figure 7:
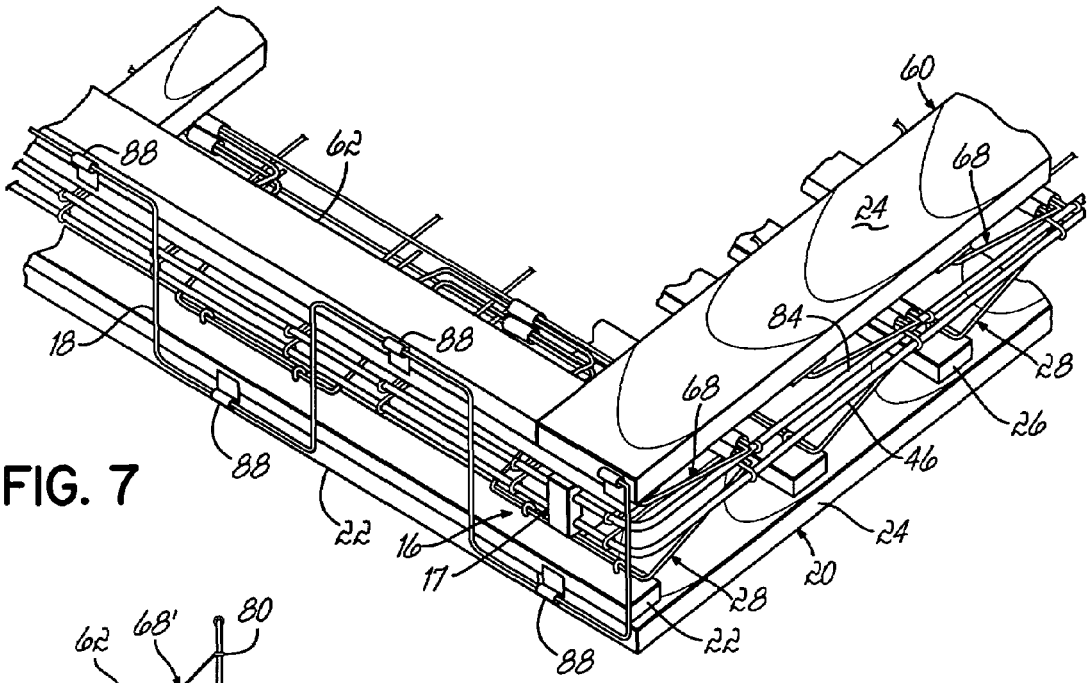
FIG. 7 is a perspective view of a portion of the bottom hinge of the bedding foundation of FIG. 1.

As best seen in FIG. 7, the lower hinge 18 connects the first base 20 to the second base 60 and more particularly connects one of the end rails 22 of the first base 20 to one of the end rails 62 of the second base 60. In one embodiment, illustrated in FIGS. 1 and 7, the lower hinge 18 comprises a wire having a square wave shape which is secured to the end rails 22, 62 of the first and second bases 20, 60, respectively with clips 88. Other means of securing the lower hinge 18 to the bases 20, 60 may be used if desired. In accordance with the present invention, the lower hinge may assume other configurations and be made of any suitable material.

Figure 9:
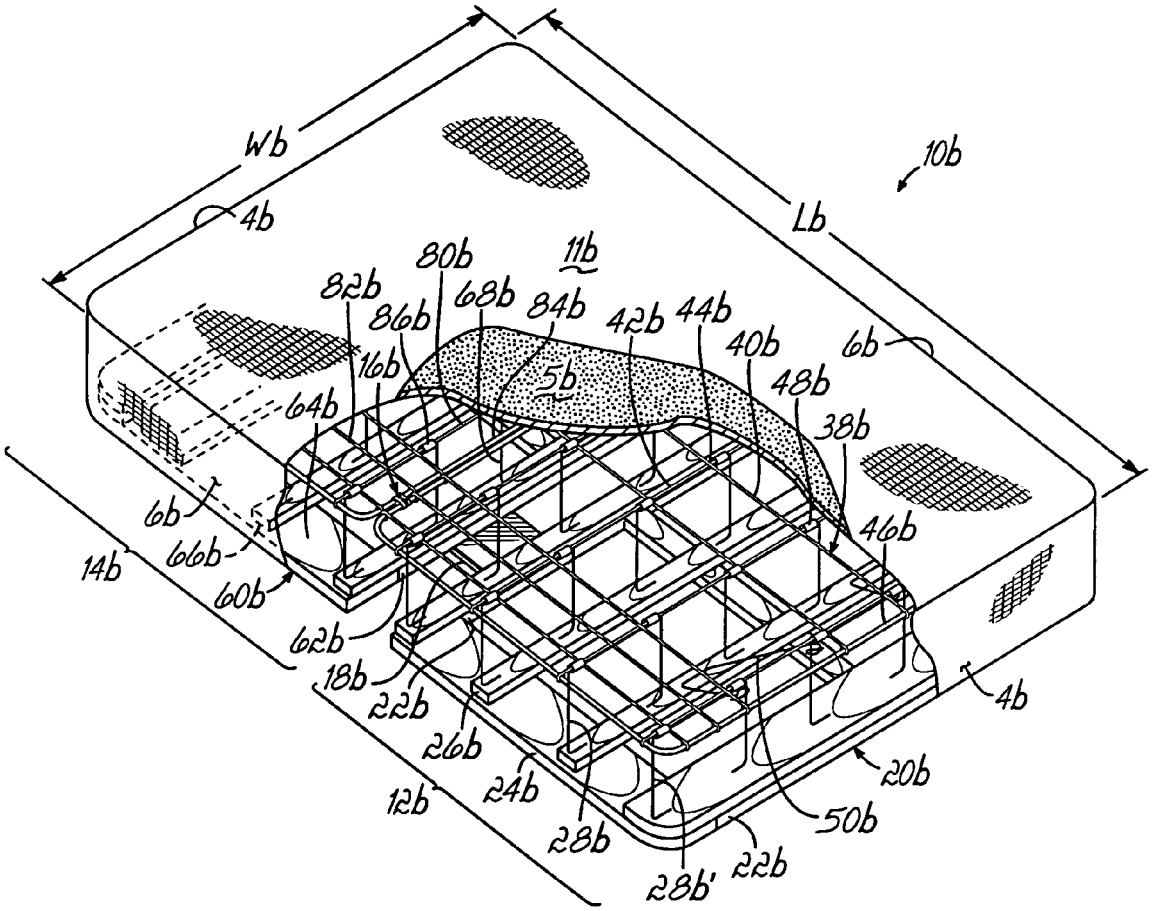
FIG. 9 is a perspective view of another alternative embodiment of the collapsible bedding foundation of the present invention in an erected condition.

FIGS. 9-12 illustrate an alternative embodiment of collapsible bedding foundation 10*b*. The bedding foundation 10*b* has a pair of end surfaces 4*b* defining a length or longitudinal dimension Lb of the foundation 10*b* and a pair of opposed side surfaces 6*b* defining a width Wb of the foundation 10*b*. The bedding foundation 10*b* has a first section 12*b* hinged to a second section 14*b* with a pair of upper connectors or spacers 16*b* and a pair of lower connectors or spacers 18*b*. Each upper connector 16*b* is shown in detail in FIG. 13. Each lower connector 18*b* is shown in detail in FIGS. 11 and 12. The connectors 16*b*, 18*b* enable the bedding foundation 10*b* to move from an erected position shown in FIG. 9 to a collapsed position shown in FIG. 11. The bedding foundation 10*b* may be collapsed with a surrounding cover 11*b* as shown in FIG. 9. If desired padding 5*b* may be placed on the upper surface of the bedding product 10*b* before the surrounding cover 11*b* is attached.

Figure 10:
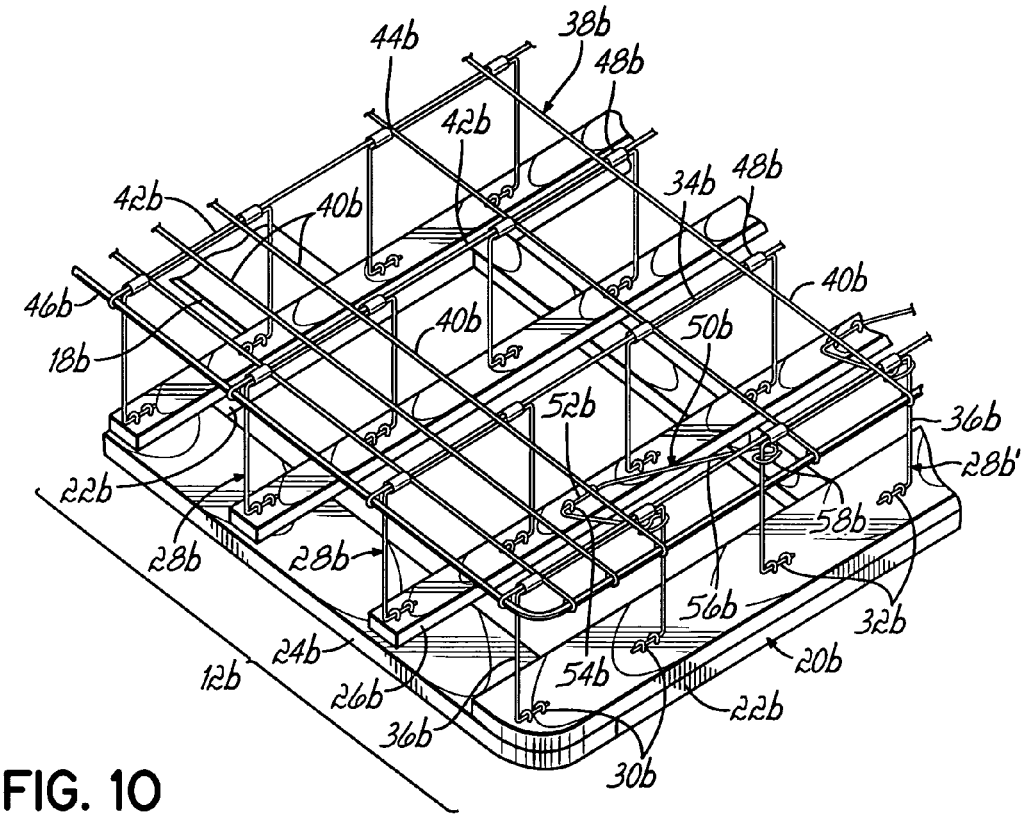
FIG. 10 is an enlarged perspective view of a portion of one section of the collapsible bedding foundation of FIG. 9.
Figure 14:
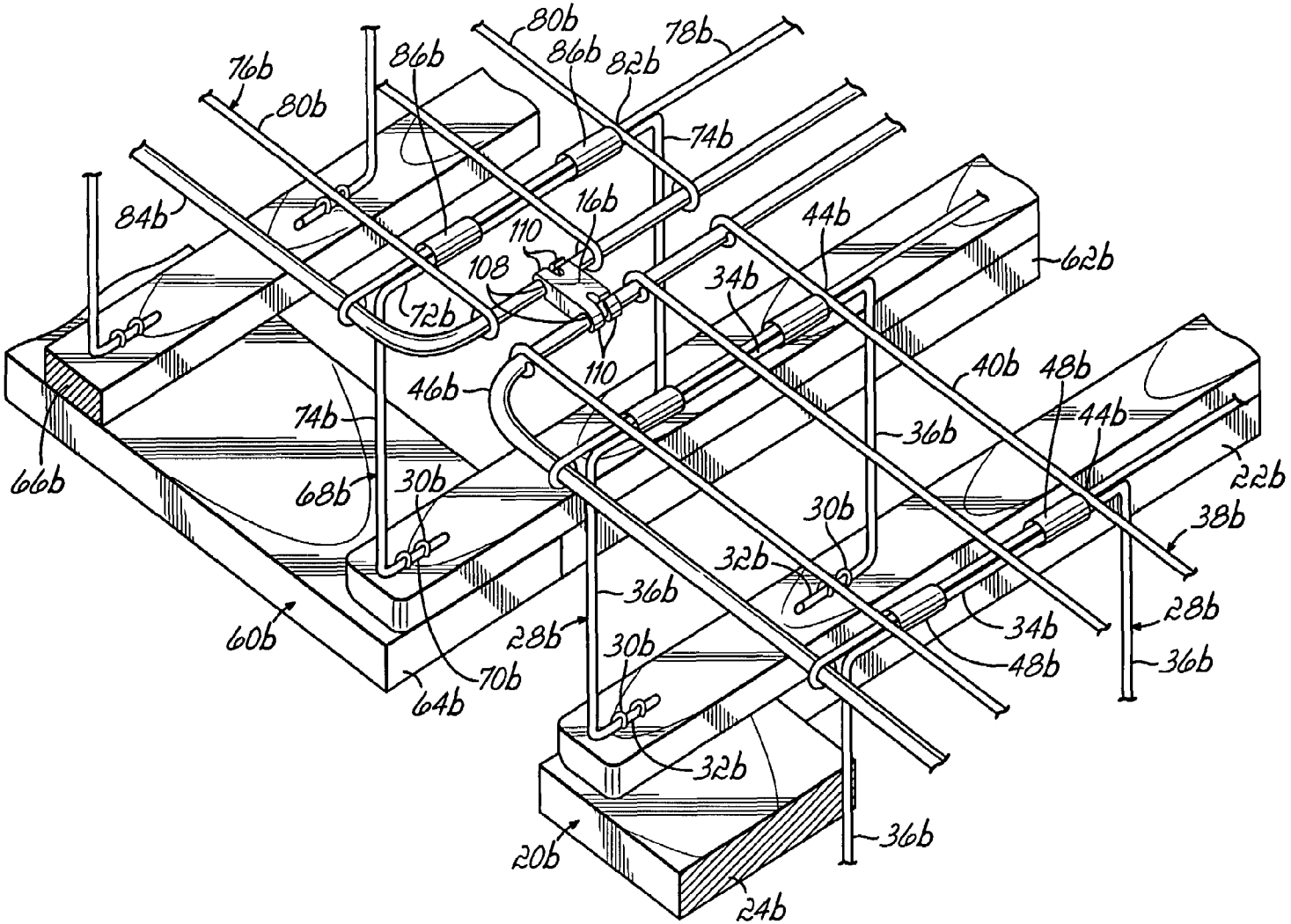
FIG. 14 is an enlarged perspective view of the embodiment of bedding foundation shown in FIG. 9.

Referring to FIGS. 9 and 10, the first section 12*b* comprises a first base 20*b* having a pair of opposed end rails 22*b*, a pair of opposed side rails 24*b* and a plurality of cross rails 26*b*. As shown in FIGS. 10 and 14, a plurality of first wire struts or body supports 28*b* are pivotally secured to the cross rails 26*b* and end rails 22*b* of the first base 20*b* with staples 30*b*. Each wire strut 28*b* has a generally inverted U-shaped configuration including a pair of spaced lower portions 32*b* which are co-linear and an upper portion 34*b*. The upper and lower portions 34*b*, 32*b* are joined with spaced, parallel connecting portions 36*b*. The lower portions 32*b* of each wire strut 28*b* are stapled to the cross rails 26*b* and end rails 22*b* of the first base 20*b* with staples 30*b* so the wire struts 28*b* may pivot relative to the first base 20*b*. When the bedding foundation 10*b* is in its erected condition or position as shown in FIGS. 9 and 10, the connecting portions 36*b* of the wire struts 28*b* are vertically oriented and the upper and lower portions 34*b*, 32*b* of the wire struts 28*b* are horizontally oriented.

As seen in FIG. 10, the first section 12*b* of the collapsible bedding foundation 10*b* further comprises a first upper grid 38*b* comprising a plurality of spaced, parallel longitudinal grid wires 40*b* and a plurality of spaced, parallel transverse grid wires 42*b* intersecting with and secured to the longitudinal grid wires 40*b* at intersections 44*b*. A generally rectangular border wire 46*b* surrounds the longitudinal grid wires 40*b* and transverse grid wires 42*b* and forms a part of the upper grid 38*b*. The ends of the longitudinal grid wires 40*b* and transverse grid wires 42*b* are wrapped around, welded or otherwise secured to the border wire 46*b*, as is conventional.

As best seen in FIG. 10, the upper portions 34*b* of wire struts 28*b* are pivotally secured to the transverse grid wires 42*b* of the first upper grid 38*b* with metal clips 48*b* so the wire struts 28*b* may pivot relative to the first upper grid 38*b*. Securing devices other than metal clips such as plastic clips or helical lacing wires may used if desired to pivotally secure the upper portions 34*b* of the wire struts 28*b* to the transverse grid wires 42*b* of the first upper grid 38*b*. As best shown in FIG. 14, although two metal clips 48*b* are illustrated securing each wire strut 28*b* to a transverse grid wire 42*b*, any number of metal clips 48*b* may be used to do so.

Figure 11:
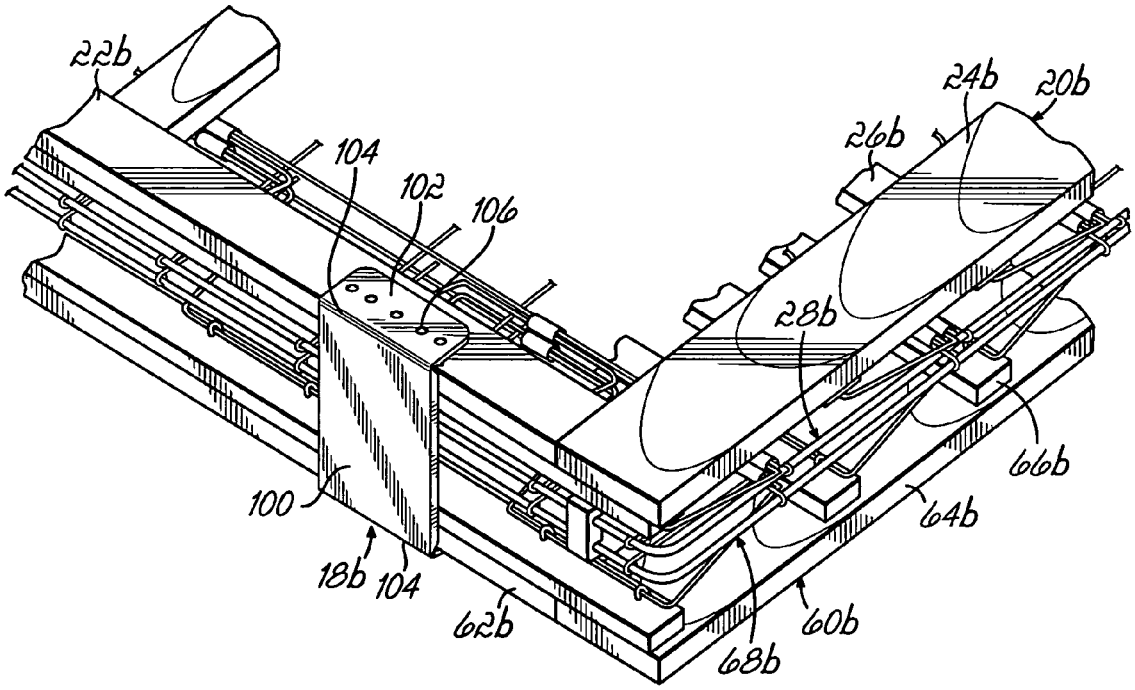
FIG. 11 is a perspective view, like FIG. 7, of one lower connector showing the embodiment of bedding foundation shown in FIG. 9 collapsed.

As shown in FIGS. 9 and 10, a pair of braces 50*b*, exactly like braces 50 described above, extend between one of the cross rails 26*b* of the first base 20*b* and outermost wire struts 28*b*' of the first section 12*b* of the bedding foundation 10*b*. As best illustrated in FIG. 10, each brace 50*b* comprises a linear bottom portion 52*b* pivotally secured to the cross rail 26*b* with staples 54*b* and a pair of arms 56*b* extending outwardly from opposed ends of the bottom portion 52*b* of the brace 50*b*. Each arm 56*b* terminates in an end portion 58*b* which comprises an arched or arcuate wire wrapped around one of the connecting portions 36*b* of one of the outermost wire struts 28*b*'. As the bedding foundation 10*b* is collapsed from its erected position shown in FIG. 9 to its collapsed position shown in FIG. 11, the end portions 58*b* of the braces 50*b* slide down the connecting portions 36*b* of the outermost wire struts 28*b*' until they come to rest in a substantially horizontal orientation as shown in FIG. 11.

Figure 10A:
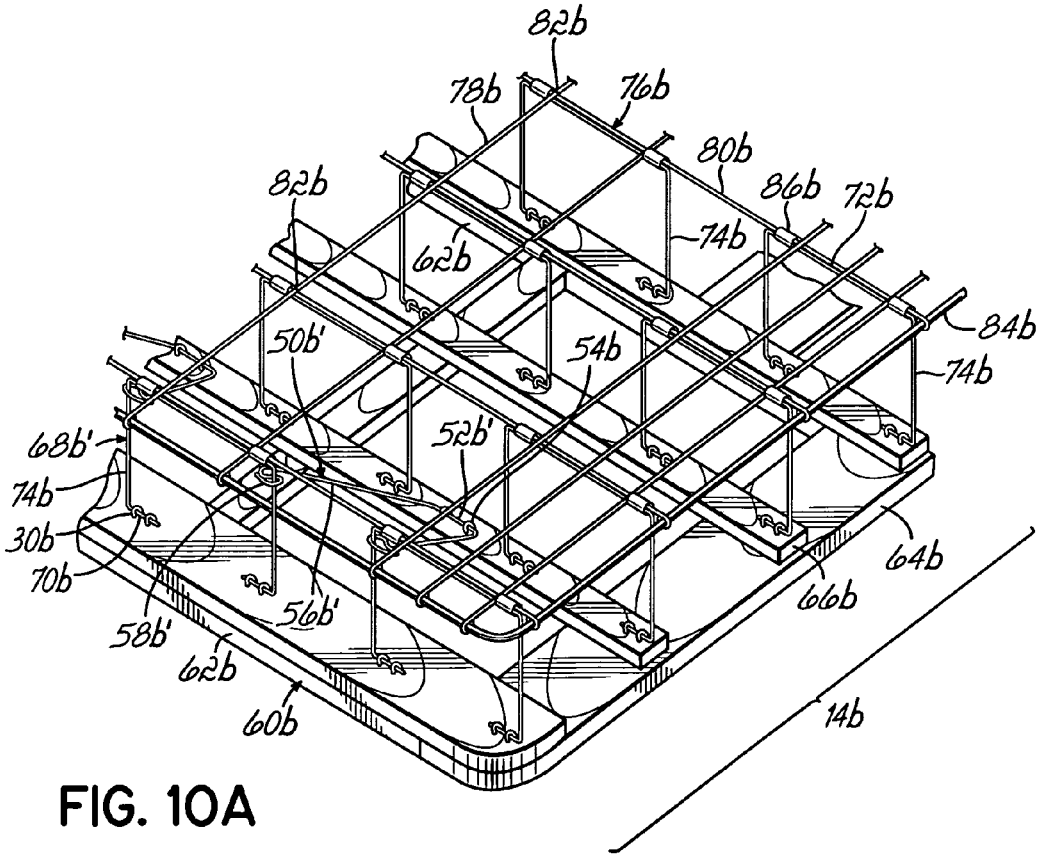
FIG. 10A is an enlarged perspective view of a portion of the second section of the collapsible bedding foundation of FIG. 9.

Referring to FIGS. 9 and 10A, the second section 14*b* of the bedding foundation 10*b* comprises a second base 60*b* having a pair of opposed end rails 62*b*, a pair of opposed side rails 64*b* and a plurality of cross rails 66*b*, as is conventional. As shown in FIGS. 10A and 14, a plurality of second wire struts or body supports 68*b* are pivotally secured to the cross rails 66*b* and end rails 62*b* of the second base 60*b* with staples 30*b*. Each wire strut 68*b* has an inverted U-shape including a plurality of spaced lower portions 70*b* which are co-linear and an upper portion 72*b*. The upper portion 72*b* is joined to the lower portions 70*b* are joined with spaced, parallel connecting portions 74*b*. The lower portions 70*b* of each wire strut 68*b* are stapled to the cross rails 66*b* and end rails 62*b* of the second base 60*b* with staples 30*b* so the wire strut 68*b* may pivot relative to the second base 60*b*. When the bedding foundation 10*b* is in its erected condition or position as shown in FIGS. 9 and 14, the connecting portions 74*b* of the wire struts 68*b* are vertically oriented and the upper and lower portions 72*b*, 70*b* of the wire struts 68*b* are horizontally oriented.

Referring to FIG. 10A, the second section 14*b* of the collapsible bedding foundation 10 further comprises a second upper grid 76*b* comprising a plurality of spaced, parallel longitudinal grid wires 78*b* and a plurality of spaced, parallel transverse grid wires 80*b* intersecting with and secured to the longitudinal grid wires 78*b* at intersections 82*b*. A generally rectangular border wire 84*b* surrounds the longitudinal grid wires 78*b* and transverse grid wires 80*b* and forms a part of the upper grid 76*b*. The ends of the longitudinal grid wires 78*b* and transverse grid wires 80*b* are wrapped around, welded or otherwise secured to the border wire 84*b*, as is conventional.

The upper portions 72*b* of each wire strut 68*b* are pivotally secured to the transverse grid wires 80*b* of the second upper grid 76*b* with metal clips 86*b* so the wire strut 68*b* may pivot relative to the second upper grid 76*b*. Securing devices other than metal clips such as plastic clips or helical lacing wires may used if desired to pivotally secure the upper portions 72*b* of the wire struts 68*b* to the transverse grid wires 80*b* of the second upper grid 76*b*. As best shown in FIG. 14, although two metal clips 86*b* are illustrated securing the upper portion 72*b* of each wire strut 68*b* to a transverse grid wire 80*b*, any number of metal clips 86*b* may be used to do so.

As shown in FIG. 10A, a pair of braces 50*b*' extend between one of the cross rails 66*b* of the second base 60*b* and an outermost wire strut 68*b*' of the second section 14*b* of the bedding foundation 10*b*. As best illustrated in FIG. 10A, each brace 50*b*' is a mirror image of brace 50 shown in FIG. 3. Each brace 50*b*' has a bottom portion 52*b*' which is pivotally secured to the cross rail 66*b* with staples 54*b* and a pair of arms 56*b*' extending outwardly from opposed ends of the bottom portion 52*b*' of the brace 50*b*'. Each arm 56*b*' terminates in an end portion 58*b*' which comprises an arched or arcuate wire wrapped around one of the connecting portions 74*b* of outermost wire struts 68*b*'. As the bedding foundation 10*b* is collapsed from its erected position shown in FIG. 9 to its collapsed position shown in FIG. 1, the end portions 58*b*' of the braces 50*b*' slide down the connecting portions 74*b* of outermost wire struts 68*b*' until they come to rest in a substantially horizontal orientation as shown in FIG. 11.

Figure 12:
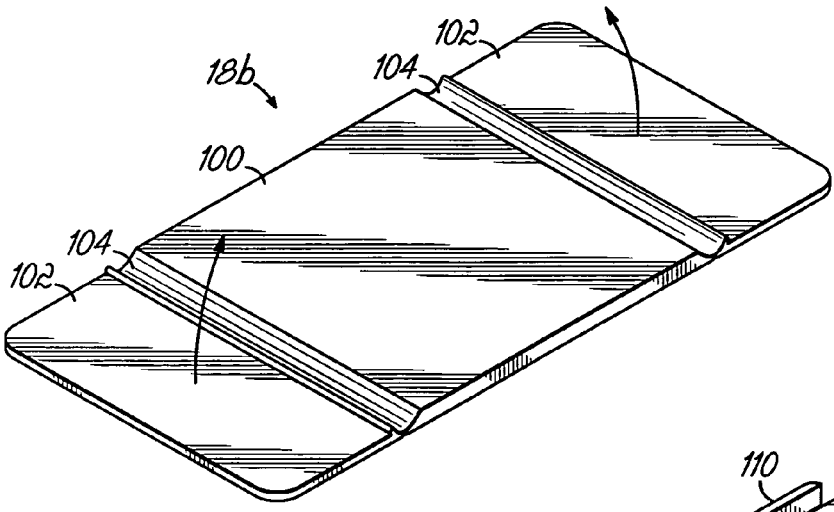
FIG. 12 is a perspective view of the lower connector of FIG. 10 in a planar orientation showing the living hinges of this lower connector.

As best seen in FIG. 11, the lower connectors 18*b* connect the first base 20*b* to the second base 60*b* and more particularly connect one of the end rails 22*b* of the first base 20*b* to one of the end rails 62*b* of the second base 60*b*. In one embodiment, illustrated in FIGS. 11 and 12, each lower connector 18*b* comprises a generally rectangular piece of plastic or any other suitable material. The lower hinge or connector 18*b* has a middle portion 100 and a pair of end portions 102, each joined to the middle portion 100 with a living hinge 104 which facilitates bending the lower connector 18*b* from a generally planar orientation shown in FIGS. 9 and 12 to a generally U-shaped configuration shown in FIG. 11. As seen in FIG. 1, the end portions 102 of each lower connector 18*b* are secured to the end rails 22*b*, 62*b* of the first and second bases 20*b*, 60*b*, respectively with fasteners 106. Other means of securing the lower hinge 18*b* to the bases 20*b*, 60*b* may be used if desired. In accordance with the present invention, the lower connectors may assume other configurations and be made of any suitable material. Any number of lower connectors as shown in FIG. 12 may be used in accordance with the present invention to secure the bases together yet still enable the bedding foundation to collapse.

Figure 13:
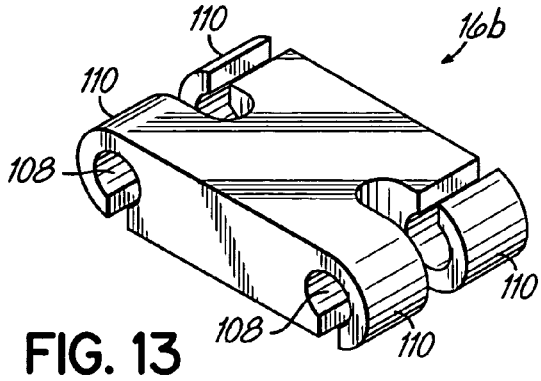
FIG. 13 is a perspective view of an upper connector which may be used in accordance with any embodiment of the present invention.

FIG. 13 illustrates one of the upper connectors 16*b* having a pair of grooves 108 each being formed or sized to receive and retain portions of the border wires 46*b*, 84*b*. See FIG. 14. Each groove 108 is created by a pair of C-shaped retainers 110 inverted relative to each other. Each upper connector 16*b* is preferably a unitary plastic part but may be made of multiple components and/or be made of any desired material. In accordance with the present invention, the upper connector 16*b* may assume other configurations and be made of any suitable material. Although only one of two upper connectors 16*b* is illustrated in FIG. 9, any number of upper connectors 16*b* may be used to secure and space the grids of the sections 12*b*, 14*b* of the bedding foundation 10*b*, thereby easing the collapsibility of the product.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art.

Therefore, the invention in its broadest aspects is not limited to the specific details shown and described. Consequently, departures may be made from the details described herein without departing from the spirit and scope of the claims which follow.

What is claimed is:

1. A foldable bedding foundation comprising:

a first section having a first base, a first plurality of wire support members pivotally secured to said first base of said first section, a first upper wire grid pivotally secured to said first wire support members and braces extending between the first base and an outermost wire support member of the first plurality of wire support members;

a second section having a second base, a second plurality of wire support members pivotally secured to said second base of said second section, a second upper wire grid pivotally secured to said second wire support members and braces extending between the second base and an outermost wire support member of the second plurality of wire support members; and lower connectors secured to and extending between the first and second bases, wherein each of said lower connectors is made of plastic and has a pair of living hinges and assumes a U-shaped configuration when the bedding foundation is folded.

2. The foldable bedding foundation of claim 1 further comprising upper connectors secured to and extending between the first and second upper wire grids.

3. The foldable bedding foundation of claim 2 wherein each of said upper connectors is made of plastic.

4. The foldable bedding foundation of claim 1 wherein each of the braces is generally V-shaped.

5. The foldable bedding foundation of claim 1 wherein each of the braces has a pair of arms terminating in arcuate end portions which are slidably engaged with the outermost wire strut of each section of the bedding foundation.

6. A foldable bedding foundation comprising:

a first section having a first base including side rails, end rails and a plurality of cross rails extending between the side rails, a first plurality of generally U-shaped wire struts pivotally secured to said first base of said first section, a first upper wire grid pivotally secured to said first wire struts and braces pivotally secured to one of the cross rails of the first base and engaged with an outermost wire strut of the first plurality of wire struts;

a second section having a second base including side rails, end rails and a plurality of cross rails extending between the side rails, a second plurality of generally U-shaped wire struts pivotally secured to said second base of said second section, a second upper wire grid pivotally secured to said second wire struts and braces pivotally secured to one of the cross rails of the second base and engaged with an outermost wire strut of the second plurality of wire struts;

spaced lower connectors secured to and extending between the first and second bases wherein each of said lower connectors is made of plastic and has a pair of living hinges; and spaced upper connectors secured to and extending between the first and second upper wire grids wherein said braces of said first and second sections are slideable on said outermost wire struts.

7. The foldable bedding foundation of claim 6 wherein each of said upper connectors is made of plastic.

8. The foldable bedding foundation of claim 6 wherein said braces are movable between an upper position and a lower position.

9. The foldable bedding foundation of claim 8 wherein said bedding foundation is collapsed when said braces are in said lower position.

10. The foldable bedding foundation of claim 8 wherein said bedding foundation is erect when said braces are in said upper position.

11. A foldable bedding foundation comprising:

a first section having a first base including side rails, end rails and a plurality of cross rails extending between the side rails, a first plurality of wire struts pivotally secured to said first base of said first section, a first upper wire grid pivotally secured to said first wire struts;

a second section having a second base including side rails, end rails and a plurality of cross rails extending between the side rails, a second plurality of wire struts pivotally secured to said second base of said second section, a second upper wire grid pivotally secured to said second wire struts;

generally rectangular lower connectors secured to and extending between the first and second bases, each of the lower connectors having a pair of living hinges such that each of the lower connectors assumes a generally U-shaped configuration when said bedding foundation is collapsed;

upper connectors secured to and extending between the first and second upper wire grids; and braces pivotally secured to the first and second bases and slidably engaged with an outermost wire struts of the first and second sections of the bedding foundation wherein said bedding foundation may be collapsed only when said braces are lowered.

12. The foldable bedding foundation of claim 11 wherein one of said sections is folded on top of the other of said sections when said bedding foundation is collapsed.

13. The foldable bedding foundation of claim 11 wherein said wire struts of said first and second sections are generally vertically oriented when said bedding foundation is erected and generally horizontally oriented when said bedding foundation is collapsed.

* * * * *

UNITED STATES PATENT AND TRADEMARK OFFICE

CERTIFICATE OF CORRECTION

PATENT NO. : 7,376,989 B2
APPLICATION NO. : 11/326005
DATED : May 27, 2008
INVENTOR(S) : Brenda Wickstrom and Niels S. Mossbeck It is certified that error appears in the above-identified patent and that said Letters Patent is hereby corrected as shown below:

Column 2, Title Page

Line 4, "has base" should be ---has a base---.

Line 9, "hinges is secured" should be ---hinges are secured---.

Line 9, "extends between" should be ---extend between---.

In the Specification

Column 2

Line 35, "process by be" should be ---process may be---.

Column 4

Line 26, "111 as shown" should be ---11 as shown---.

Line 64, "may used" should be ---may be used---.

Column 5

Line 55, "may used" should be ---may be used---.

Signed and Sealed this
Fourteenth Day of October, 2014

Michelle K. Lee

Michelle K. Lee
*Deputy Director of the United States Patent and Trademark Office*

Column 7

Line 51, “may used” should be ---may be used---.

Line 9, “hinges is secured” should be ---hinges are secured---.

Column 8

Line 17, “portions” should be ---portion---.

Line 17, delete “are joined”.

Line 46, “may used” should be ---may be used---.

Line 66, “Fig. 1” should be ---Fig. 11---.

Column 9

Line 16, “Fig. 1” should be ---Fig. 11---.

Column 11

Line 13, “with an outermost” should be ---with outermost---.